US005921838A

United States Patent [19]

Pack et al.

[11] Patent Number: 5,921,838

[45] Date of Patent: Jul. 13, 1999

[54] METHOD FOR PROTECTING EXTRACTION ELECTRODE DURING PROCESSING OF SPINDT-TIP FIELD EMITTERS

[75] Inventors: Sung P. Pack, Tempe; Patricia A. Norton; Robert F. Woodburn, Jr., both of Mesa, all of Ariz.

[73] Assignee: Motorola, Inc., Schaumburg, Ill.

[21] Appl. No.: 08/774,820

[22] Filed: Dec. 27, 1996

[51] Int. Cl.[6] ..... H01J 9/02

[52] U.S. Cl. ..... 445/50

[58] Field of Search ..... 313/309; 445/24, 445/50

[56] References Cited

U.S. PATENT DOCUMENTS

| | | | |
|---|---|---|---|
| 5,141,460 | 8/1992 | Jaskie et al. | 445/24 |
| 5,702,281 | 12/1997 | Huang et al. | 445/24 |

OTHER PUBLICATIONS

"Field Emission Characteristics of Diamond Coated Silicon Field Emitters" by J. Liu et al., *J. Vac. Sci. Technol.,* 13(2), Mar./Apr. 1995, pp. 422–426.

"Influence of Cathode Material on Emission Characteristics of Field Emitters for Microelectronics Devices" by Junzo Ishikawa et al., *J. Vac. Sci. Technol.,* vol. 11, No. 2, Mar./Apr. 1993, pp. 403–406.

"Effects of Potassium and Lithium Metal Deposition on the Emission Characteristics of Spindt–type Thin–film Field Emission Microcathode Arrays" by A.A. Talin et al., *J. Vac. Sci. Technol.,* 13(2), Mar./Apr. 1995, pp. 448–451.

*Primary Examiner*—Kenneth J. Ramsey
*Attorney, Agent, or Firm*—S. Kevin Pickens; Kate Tobin

[57] ABSTRACT

A method for protecting extraction electrodes (140) during processing of Spindt-tip field emitters (150, 155) includes the steps of: (i) depositing a parting layer (170) on the extraction electrodes (140) and in an interspace region (145) defined by the extraction electrodes (140), (ii) sharpening the Spindt-tip field emitters (150), (iii) depositing a layer (180) of emission-enhancing material on the sharpened field emitters (155) and on the parting layer (170), and (iv) removing the parting layer (170), thereby lifting off the emission-enhancing material from the extraction electrodes (140) and from the interspace region (145), but not from the sharpened field emitters (155).

4 Claims, 2 Drawing Sheets

METHOD FOR PROTECTING EXTRACTION ELECTRODE DURING PROCESSING OF SPINDT-TIP FIELD EMITTERS

FIELD OF THE INVENTION

The present invention pertains to the field of field emission devices and, more particularly, to a method for shaping and coating Spindt-type field emitters.

BACKGROUND OF THE INVENTION

Field emission devices, and addressable matrices of field emission devices, are known in the art. Selectively addressable arrays of field emission devices are used in, for example, field emission displays. These devices include extraction electrodes (gates) formed on a dielectric for selectively addressing the field emitters, such as Spindt-tip field emitters. It is known in the prior art that the material of the extraction electrodes differs from that of the field emitters and that the Spindt-tip field emitters are treated to provide a sharper tip which increases the local electric field strength at the electron emission tip, thereby reducing voltage requirements. Because the material comprising the extraction electrodes differs from the material comprising the field emitter, it is possible to choose a sharpening etchant which selectively etches the field emitter tip while being inert to the extraction electrode. For example, it is known to make the Spindt-tip field emitters from niobium and molybdenum, wherein the upper, tip portion includes the molybdenum. Prior to the cone deposition, the extraction electrodes, which are made from niobium, are patterned on the dielectric. A parting layer of nickel is then formed on the niobium. After the deposition of the molybdenum Spindt-tip field emitters in emitter wells formed in the dielectric, the excess emitter material is removed by selectively etching the parting layer, upon which the excess emitter material is disposed. Thereafter, the tips of the field emitters are sharpened using an oxygen plasma followed by an $SF_6$ plasma, to which the extraction electrodes are inert. However, this prior art scheme is not suitable for use in configurations wherein the material comprising the extraction electrode is the same as the material comprising the field emitter tip; an etchant with respect to the field emitter tip is thereby also an etchant with respect to the extraction electrode.

It is also known in the art to coat field emitters with a material which enhances field emission of electrons therefrom and field emission stability. These coating schemes have only been performed on non-addressable arrays. A tip coating process for an addressable array of field emitters, however, must preserve the electrical isolation between individual extraction electrodes. Tip coating materials in the art include gold and diamond. These efforts have not addressed methods for selectively depositing the coating materials on the tips while preventing their deposition in the regions between individual extraction electrodes. Prior art coating schemes have involved only single tips or simultaneously addressable arrays of tips. Conductive coating materials not adequately removed from the regions between individual extraction electrodes of selectively addressable arrays would destroy electrical isolation therebetween, thereby not realizing addressability of the array.

Thus, there exists a need for a method for shaping and coating Spindt-type field emitters which preserves the integrity of, and electrical isolation between, the extraction electrodes.

BRIEF DESCRIPTION OF THE DRAWINGS

Referring to the drawings.

DESCRIPTION OF THE PREFERRED EMBODIMENT

Figure 1:
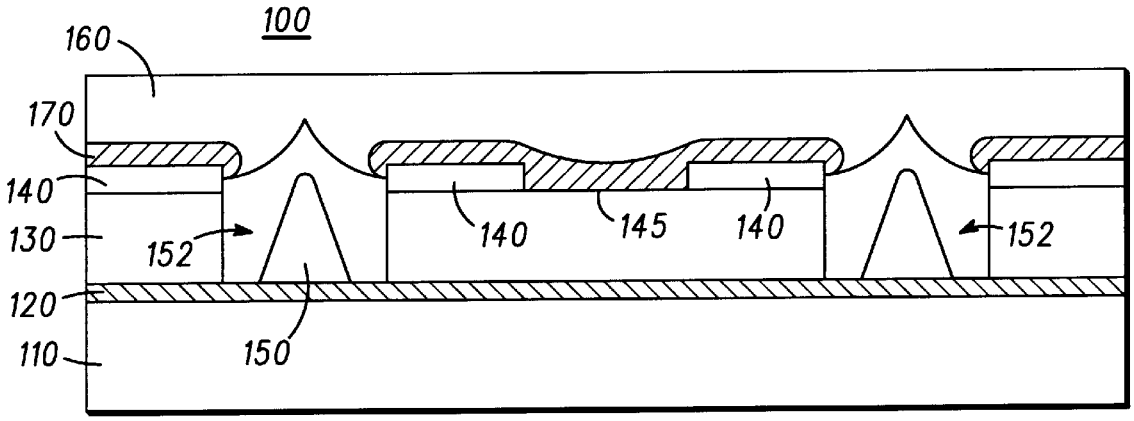
FIGS. 1–5 are cross-sectional views of structures realized by performing various steps of a method for protecting a plurality of extraction electrodes during processing of a plurality of Spindt-tip field emitters in accordance with the present invention.

Referring now to FIG. 1, there is depicted a cross-sectional view of a structure 100 realized by performing various steps of a method for protecting a plurality of extraction electrodes 140 during processing of a plurality of Spindt-tip field emitters 150, in accordance with the present invention. Structure 100 is formed by first providing a supporting substrate 110, which is made from a hard material such as glass or silicon. A cathode electrode 120 is patterned on a major surface of supporting substrate 110 and is made from a conductive material such as aluminum, niobium, or molybdenum. Cathode electrode 120 may include a ballasting portion (not shown) underneath each of plurality of Spindt-tip field emitters 150. Upon cathode electrode 120 is formed a dielectric layer 130, which is made from a dielectric material such as silicon dioxide, for electrically isolating cathode electrode 120 from extraction electrodes 140. Extraction electrodes 140 are deposited onto dielectric layer 130 and define an interspace region 145 to provide electrical isolation between extraction electrodes 140 and thereby provide the addressability of Spindt-tip field emitters 150. In this particular embodiment extraction electrodes 140 are made from molybdenum. A plurality of emitter wells 152 are formed by selectively etching through extraction electrodes 140 and dielectric layer 130. Thereafter, a parting layer 170 is deposited on extraction electrodes 140 and within interspace region 145. Parting layer 170 is made from aluminum which is deposited using an angle evaporation process so that the aluminum is not deposited within emitter wells 152. Spindt-tip field emitters 150 are formed within emitter wells 152 by cone evaporation techniques known to one skilled in the art. The cone evaporation yields a layer 160 comprised of the field emitter material, which, in this particular embodiment, includes molybdenum.

Figure 2:
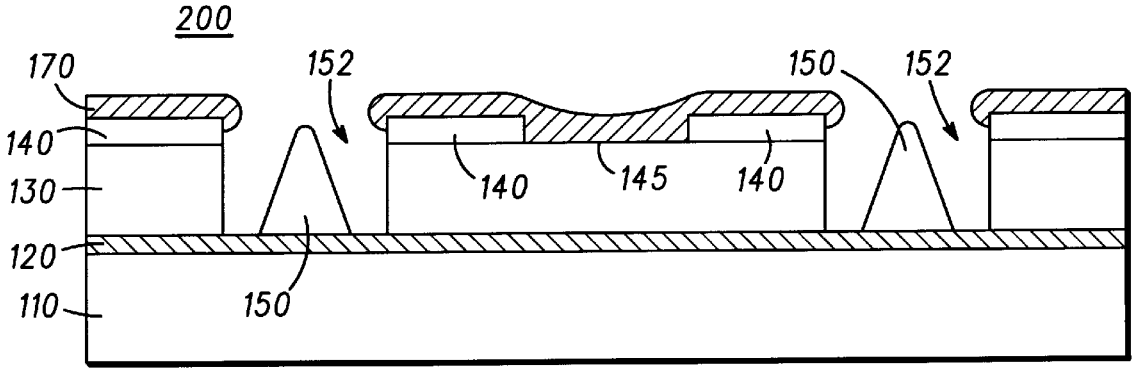

Referring now to FIG. 2, there is depicted a cross-sectional view of a structure 200 realized by performing upon structure 100 (FIG. 1) the step of removing layer 160. Layer 160 is removed by selective etching using an $SF_6$ plasma etchant, thereby exposing Spindt-tip field emitters 150 and parting layer 170. The etching may be performed in a reactive ion etching (RIE) system. Structure 200 provides a structure suitable for processing Spindt-tip field emitters 150 while simultaneously protecting extraction electrodes 140 from any steps which would otherwise be adverse to extraction electrodes 140. After Spindt-tip field emitters 150 are thereby processed, parting layer 170 is selectively removed to provide the electrical isolation between extraction electrodes 140 by removing the aluminum from interspace region 145.

Figure 3:
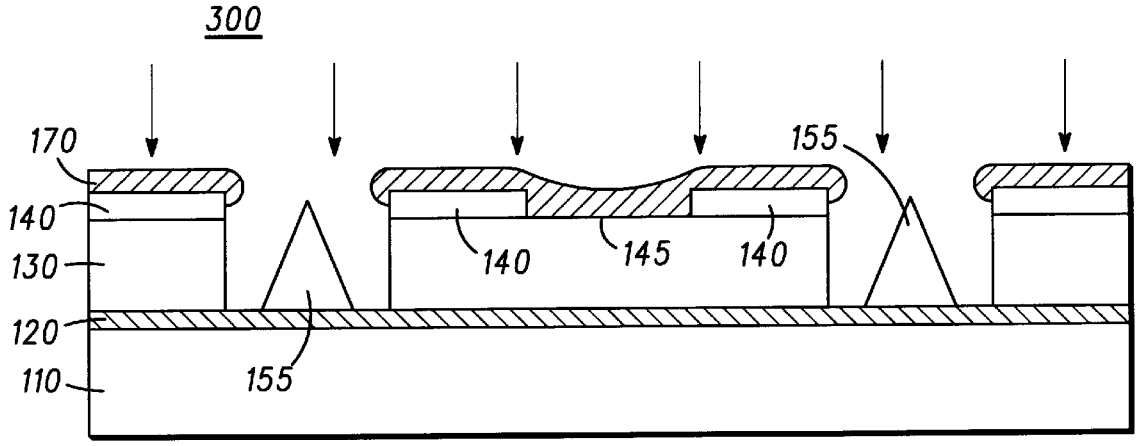

Referring now to FIG. 3, there is depicted a structure 300 realized by performing upon structure 200 (FIG. 2) additional steps of a method in accordance with the present invention. Subsequent the formation of Spindt-tip field emitters 150 and the removal of layer 160, Spindt-tip field emitters 150 are processed by, for example, sharpening their tips to form a plurality of sharpened field emitters 155, depicted in FIG. 3. A suitable tip-sharpening etchant, represented by arrows in FIG. 3, for molybdenum includes an oxygen plasma followed by an $SF_6$ plasma. Although extraction electrodes 140 are also made of molybdenum, they are protected from the $SF_6$ plasma treatment by the physical barrier provided by parting layer 170 which is also inert to the plasma treatment process. Other suitable tip sharpening chemistries and methods will occur to one skilled in the art.

Subsequent the tip sharpening processing of Spindt-tip field emitters 150, parting layer 170 is removed by selectively etching the aluminum using a suitable etchant, such as hot phosphoric acid, which does not etch the molybdenum of the sharpened field emitters 155 and of extraction electrodes 140.

Figure 4:
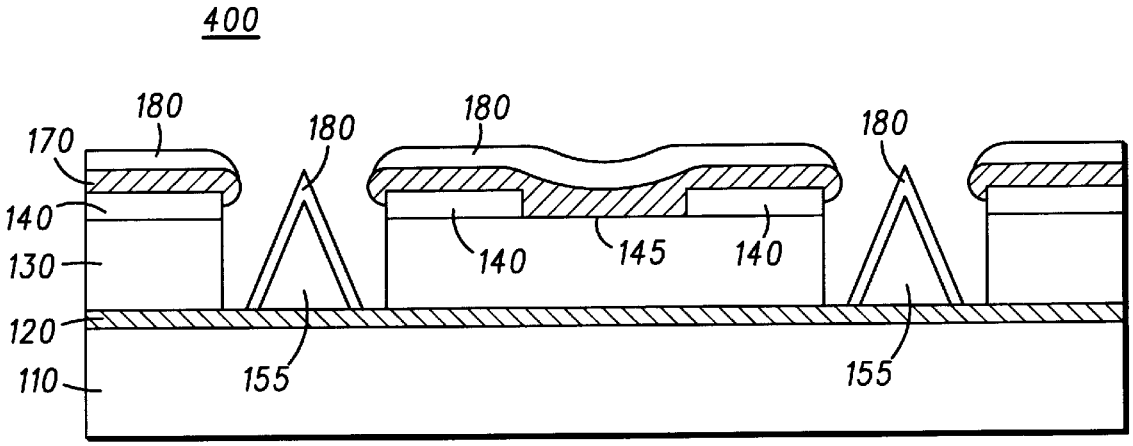

Referring now to FIG. 4, there is depicted a cross-sectional view of a structure 400 realized by performing upon structure 300 (FIG. 3) additional steps of a method in accordance with the present invention. Subsequent the sharpening of Spindt-tip field emitters 150, sharpened field emitters 155 may be coated with an emission-enhancing material, such as diamond, carbon, lithium, gold, potassium, Hf, Ru, Cs, Ti, Zr, Pt, and thin metal oxides. Such emission-enhancing materials provide benefits such as lowering the emission voltage and stabilizing emission, thereby reducing power requirements and improving reliability, respectively, of the device. For example, gold may be evaporated and deposited onto structure 300 to realize structure 400, which includes a layer 180 of the emission-enhancing material covering sharpened field emitters 155 and parting layer 170.

Figure 5:
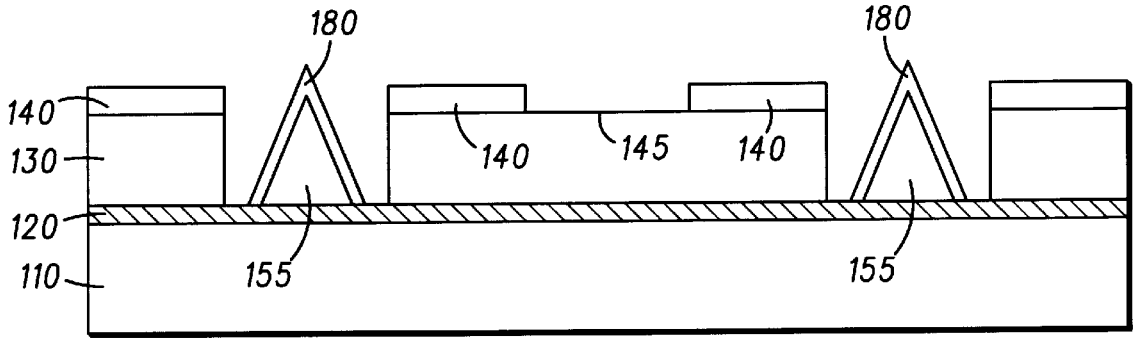

Referring now to FIG. 5, there is depicted a cross-sectional view of a structure 500 realized by performing the additional step of removing parting layer 170 from structure 400 (FIG. 4). Parting layer 170 is removed by treating structure 400 with an acid such as hydrochloric acid, phosphoric acid, or other suitable solutions. The properties of the acid are made suitable to etch away the aluminum of parting layer 170, thereby lifting off layer 180 from extraction electrodes 140 and interspace region 145, but not from sharpened field emitters 155.

In a manner similar to that described with reference to FIGS. 3–5, extraction electrodes may be protected during other types of processing of a plurality of Spindt-tip field emitters, the processing having at least one step which is adverse to the extraction electrodes. Other tip processing steps, which may be performed on structures 200, 300, or 400, in accordance with the present invention, include, for example, ion milling, implantation, and doping of the Spindt-tip field emitters. Moreover, the coating process described with reference to FIGS. 4 and 5 may be performed on structure 200 (FIG. 2) if no tip sharpening is desired. In other embodiments of the present method, the parting layer includes a sacrificial material which is eroded by the tip processing, but which precludes erosion of the extraction electrodes. Finally, by allowing the use of the same material to form the field emitters as well as the extraction electrodes, the present method simplifies the device fabrication process by obviating the need for additional processing equipment to handle another type of material.

While we have shown and described specific embodiments of the present invention, further modifications and improvements will occur to those skilled in the art. We desire it to be understood, therefore, that this invention is not limited to the particular forms shown, and we intend in the appended claims to cover all modifications that do not depart from the spirit and scope of this invention.

We claim:

1. A method for protecting a plurality of extraction electrodes during processing of a plurality of Spindt-tip field emitters including the steps of:

forming the plurality of Sprindt-tip field emitters in a dielectric layer having a major surface, wherein the plurality of Sprindt-tip field emitters is made from molybdenum;

forming the plurality of extraction electrodes on the major surface of the dielectric layer, the plurality of extraction electrode defining an interspace region, wherein the plurality of extraction electrodes is made from molybdenum;

forming a parting layer on the plurality of extraction electrodes and in the interspace region, wherein the parting layer is made from aluminum;

processing the plurality of Spindt-tip field emitters including a step being adverse to the plurality extraction electrodes; and thereafter removing the parting layer from the plurality of extraction electrodes and from the interspace region thereby protecting the integrity and electrical isolation of the plurality of extraction electrodes.

2. A method for protecting a plurality of extraction electrodes during processing of a plurality of Spindt-tip field emitters including the steps of:

forming the plurality of Spindt-tip field emitters in a dielectric layer having a major surface;

forming the plurality of extraction electrodes on the major surface of the dielectric layer, the plurality of extraction electrodes defining an interspace region;

forming a parting layer on the plurality of extraction electrodes and in the interspace region;

shaping the Spindt-tip field emitters with an etchant which is also an etchant with respect to the plurality of extraction electrodes; and thereafter removing the parting layer form the plurality of extraction electrodes and from the interspace region thereby protecting the integrity and electrical isolation of the plurality of extraction electrodes.

3. A method for protecting a plurality of extraction electrodes as claimed in claim 2 wherein the etchant includes an $SF_6$ plasma.

4. A method for protecting a plurality of extraction electrodes during processing of a plurality of Spindt-tip field emitters including the steps of:

forming the plurality of Spindt-tip field emitters in a dielectric layer having a major surface;

forming the plurality of extraction electrodes on the major surface of the dielectric layer the plurality of extraction electrodes defining an interspace region;

forming a parting layer on the plurality of extraction electrodes and in the interspace region;

coating the plurality of Spindt-tip field emitters with an emission-enhancing material, wherein the emission-enhancing material is selected from a group consisting of lithium, gold, potassium, Hf, Ru, Cs, Ti, Zr, Pt, and thin metal oxides; and thereafter removing the parting layer from the plurality of extraction electrodes and from the interspace region, thereby removing the emission-enhancing material from the interspace region thereby protecting the integrity and isolation of the plurality of extraction electrodes.

* * * * *